US008680413B2

(12) United States Patent
Taniguchi

(10) Patent No.: US 8,680,413 B2
(45) Date of Patent: Mar. 25, 2014

(54) ILLUMINATING PUSH-BUTTON DEVICE AND PORTABLE TERMINAL

(75) Inventor: Hiroyuki Taniguchi, Tokyo (JP)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 244 days.

(21) Appl. No.: 12/960,001

(22) Filed: Dec. 3, 2010

(65) Prior Publication Data

US 2011/0192708 A1 Aug. 11, 2011

Related U.S. Application Data

(60) Provisional application No. 61/303,012, filed on Feb. 10, 2010.

(51) Int. Cl.
*H01H 13/02* (2006.01)
*H01H 11/00* (2006.01)

(52) U.S. Cl.
USPC ..... 200/341; 200/345; 200/310; 200/311; 200/314; 200/313

(58) Field of Classification Search
USPC ..... 200/310, 311, 341, 345
See application file for complete search history.

(56) References Cited

U.S. PATENT DOCUMENTS

| | | | | |
|---|---|---|---|---|
| 8,207,872 | B2 * | 6/2012 | Huang et al. | 341/22 |
| 2009/0266691 | A1 * | 10/2009 | Ishioka et al. | 200/310 |
| 2010/0108486 | A1 * | 5/2010 | Yoshida | 200/520 |

FOREIGN PATENT DOCUMENTS

| | | |
|---|---|---|
| JP | 2007-220348 | 8/2007 |

* cited by examiner

*Primary Examiner* — Renee Luebke
*Assistant Examiner* — Ahmed Saeed
(74) *Attorney, Agent, or Firm* — Oblon, Spivak, McClelland, Maier & Neustadt, L.L.P.

(57) ABSTRACT

An illuminating push-button device includes a key-top part having a key-top surface and a first protrusion that protrudes from a back side of the key-top surface. The device also includes a key rubber part made of a transparent or semi-transparent elastic material and having a second protrusion that receives the first protrusion, the second protrusion being oriented in a common direction as the first protrusion. A switching device is included that opposes the second protrusion and is configured to be actuated in response to the key-top part being depressed. A light-source element emits light from a light-emitting surface and cooperates with a light-blocking sheet disposed between the light-source element and key rubber part and covers at least a portion of the light-emitting surface of the light-source element and has a loose hole through which the second protrusion of the key rubber part is passed.

18 Claims, 10 Drawing Sheets

ILLUMINATING PUSH-BUTTON DEVICE AND PORTABLE TERMINAL

CROSS REFERENCE TO RELATED APPLICATION

The present application claims the benefit of the earlier filing date of U.S. Provisional Patent Application Ser. No. 61/303,012, filed in the USPTO on Feb. 10, 2010, the entire contents of which being incorporated herein by reference.

BACKGROUND OF THE INVENTION

1. Field of the Invention

The present invention relates to an illuminating push-button device that is installed in various types of electronic apparatuses and a portable terminal that includes the illuminated push-button device.

2. Description of the Related Art

As an example of illuminating button devices installed in various types of electronic apparatuses, Japanese Unexamined Patent Application Publication No. 2007-220348 discloses an illuminating switch.

In the illuminating switch according to Japanese Unexamined Patent Application Publication No. 2007-220348, a switch and a light source are disposed on a substrate, and a key-top for pushing the switch and a first light-guiding member for guiding light from the light source to the key-top are provided. In the illuminating switch, the inner side and the outer side of the key-top are clinched with a light-guiding frame and a pushing frame. The light source is provided on the lower surface of the substrate. The light from the light source is guided from the second light-guiding member to the first light-guiding member and illuminates the key-top and its vicinity through the first light-guiding member.

SUMMARY OF THE INVENTION

As described above, the illuminating push-button device according to the related art includes various components, such as multiple light-guiding members and light-guiding frames described in Japanese Unexamined Patent Application Publication No. 2007-220348, for constituting a structure that guides light from a light source disposed on a substrate to a key-top.

Therefore, with the illuminating push-button device according to the related art, it is difficult to prevent an increase in the device price because many components including multiple light-guiding members are used and assembly of the components is costly.

Moreover, with the illuminating push-button device according to the related art, it is difficult to illuminate a key-top with sufficiently bright light because the light from the light source is guided to the key-top through the guiding members, and the light attenuates before it reaches the key-top. Furthermore, with the illuminating push-button device according to the related art, the light from the light source often leaks outside from the light-guiding members and/or from a gap between the key-top and the case.

A push-button device according to the related art includes many components, as described above, and the locations of the components have many restrictions. Therefore, the device design tends to be less flexible.

Moreover, since the push-button device according to the related art includes many components, it is difficult to provide a user with a good clicking sense when a key-top is pushed and to maintain water-proofing performance since water easily seeps in gaps between the components.

The embodiments of the present invention are conceived in light of the issues described above and provide an illuminating push-button device and a portable terminal including the illuminating push-button device that suppress costs, increase flexibility in the device design, provide an excellent clicking sense to a user, maintain waterproofing performance, sufficiently illuminate key-tops, and eliminate leakage of light.

The illuminating push-button device according to an embodiment of the present invention includes a key-top part, a key rubber part, a switching device, a light-source element, and a light-blocking sheet, wherein a key-top surface is exposed to the outside, and wherein a case accommodates the key rubber part, the switching device, the light-source element, and the light-blocking sheet. The key-top part has a first protrusion protruding from a back side of a key-top surface and is made of a transparent or semi-transparent material allowing incident light from a side of the first protrusion to be emitted outward from the entire or part of the key-top surface. The key rubber part is made of a transparent or semi-transparent elastic material and has a second protrusion into which the first protrusion of the key-top part is fit, the second protrusion protruding from a back side opposite to the side facing the key-top part. The switching device is disposed at a position relatively corresponding to the second protrusion of the key rubber part. The light-source element emits light from a light-emitting surface. The light-blocking sheet is disposed across a predetermined space on a front side of the light-emitting surface of the light-source element, covers the entire key rubber part, has a loose hole through which the second protrusion of the key rubber part is passed without contacting a sidewall of the loose hole, and is colored white on the side of the light-emitting surface of the light-source element. In this way, the illuminating push-button device according to an embodiment of the present invention solves the above-described problems.

In the illuminating push-button device according to an embodiment of the present invention, the first protrusion of the key-top part protrudes in a tapered manner such that a base is large and a tip is small and an end section at the tip has a substantially flat surface. The first protrusion of the key-top part is fit into the second protrusion of the key rubber part, and the second protrusion protrudes in a tapered manner such that a base is large and a tip is small, and an end section of the tip has a substantially flat surface with a predetermined thickness. A surface on the back side of the light-blocking sheet opposite to the surface colored white is colored black.

In the illuminating push-button device according to an embodiment of the present invention, button parts are disposed adjacent to each other, the button parts including the key-top part and the key rubber part with the first protrusion being fit into the second protrusion, and adjoining button parts have overlapping contact sections bonding end sections of the key rubber parts in an overlapping manner.

A portable terminal according to an embodiment of the present invention includes the illuminating push-button device according to an embodiment of the present invention and a terminal case exposing the key-top surface of the illuminating push-button device to the outside and accommodating the key rubber part, the switching device, the light-source element, and the light-blocking sheet.

In other words, according to an embodiment of the present invention, the first protrusion of the key-top part is fit into the second protrusion of the key rubber part, the switching device is disposed at a position relatively corresponding to the second protrusion. Therefore, when the key-top surface of the key-top part is pushed by a user, the pushing force is transmitted to the second protrusion through the first protrusion and then through the second protrusion to push the switching device.

According to an embodiment of the present invention, the key-top part and the key rubber part are both made of transparent or semi-transparent material. The light-blocking sheet is disposed across a predetermined space on a front side of the light-emitting surface of the light-source element, covers the entire key rubber part, has a loose hole through which the second protrusion of the key rubber part is passed without contacting a sidewall of the loose hole, and is colored white on the side of the light-emitting surface of the light-source element. The light emitted from the light source is diffused at the white surface of the light-blocking sheet and is emitted outside from the loose hole through the key rubber part and the key-top part.

According to an embodiment of the present invention, since the first protrusion of the key-top part is fit into the second protrusion of the key rubber part and the switching device is disposed at a position relatively corresponding to the second protrusion, the flexibility of the device design can be increased while suppressing costs, and an excellent clicking sense can be provided to the used.

According to an embodiment of the present invention, since the key-top part and the key rubber part are made of transparent or semi-transparent material, and the light-blocking sheet is disposed across a predetermined space on a front side of the light-emitting surface of the light-source element, has a loose hole, and is colored white on the side of the light-emitting surface of the light-source element, the key-top part can be sufficiently illuminated by light from the light source while eliminating leakage of light.

According to an embodiment of the present invention, since, when button parts are disposed adjacent to each other and include the key-top part and the key-rubber part with the first protrusion being fit into the second protrusion, the end section of the key rubber parts of adjoining button parts are overlapped and bonded, water is prevented from seeping in from outside, and high water-proof performance can be achieved.

DESCRIPTION OF THE PREFERRED EMBODIMENTS

An embodiment of the present invention will be described below with reference to the drawings.

Outline of Configuration of Portable Terminal

Figure 1:
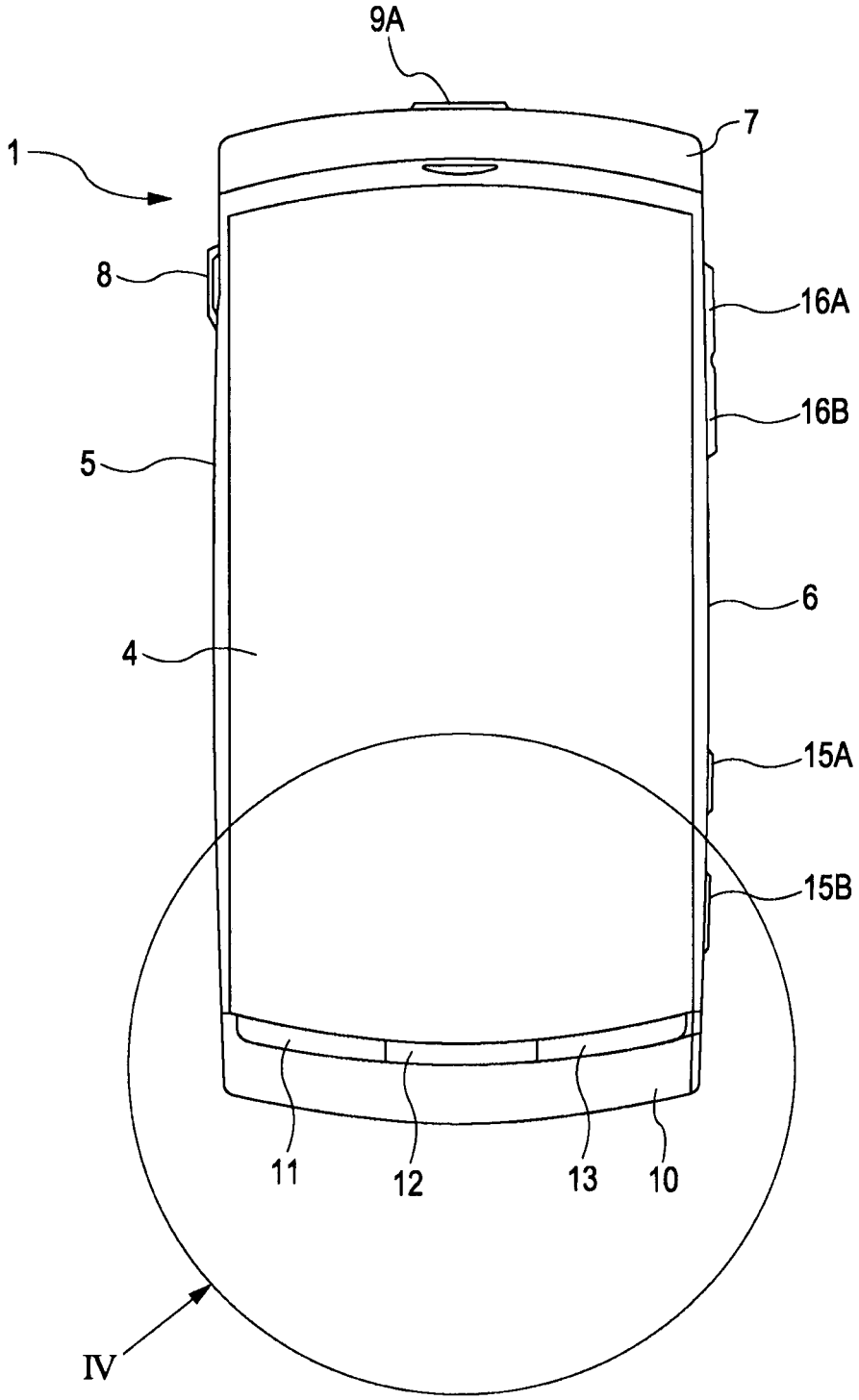
FIG. 1 is an external front view of a portable terminal according to an embodiment of the present invention.
Figure 2:
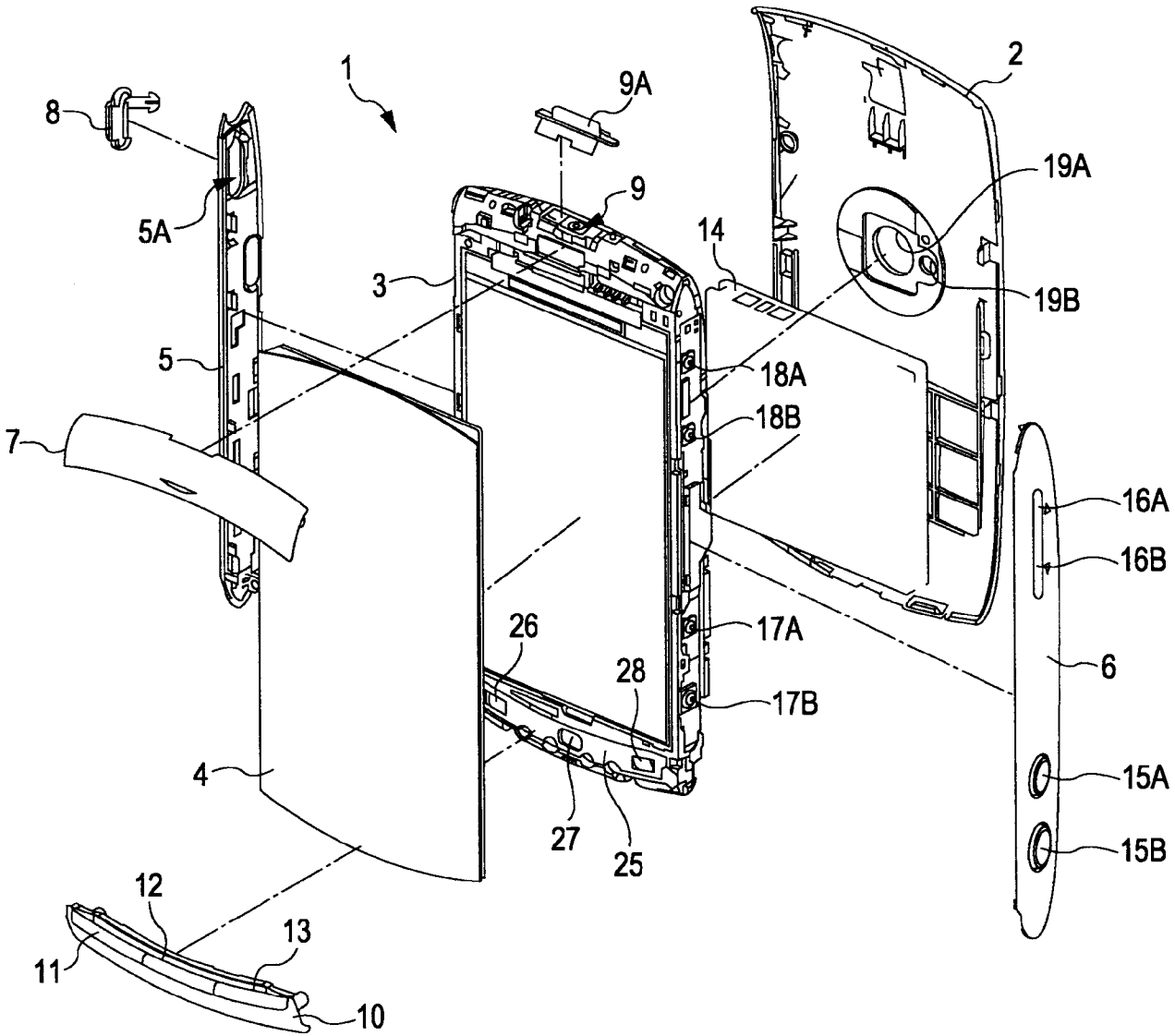
FIG. 2 is an exploded perspective view of main parts of the portable terminal according to an embodiment of the present invention.

FIG. 1 is an external front view of a portable terminal, such as a mobile phone, having illuminating push-buttons according to an embodiment of the present invention. FIG. 2 is an exploded perspective view of the main parts of the portable terminal according to an embodiment of the present invention.

As illustrated in FIGS. 1 and 2, a portable terminal 1 according to this embodiment is constituted by assembling the following main components: an inner case 3, a back-side case 2, a left-side case 5, a display touch panel 4, a right-side case 6, an upper front case 7, a lower front case 10, a battery pack 14, and so on.

The inner case 3 accommodates a main circuit board. On the front side of the inner case 3, which is the front side of the terminal, the display touch panel 4, the upper front case 7, and the lower front case 10 are attached. On the back side of the inner case 3, which is the back side of the terminal, the back-side case 2 accommodating the battery pack 14 is attached. On the inner case 3, the right-side case 6 is attached to the right-side surface, and the left-side case 5 is attached to the left-side surface. In addition, a transceiver 9 for infrared communication is attached to the inner case 3. The transceiver 9 for infrared communication is electrically coupled with the main circuit board. An infrared-transmissive lens unit 9A is attached to the infrared transmission and reception side of the transceiver 9.

The display touch panel 4 is an integrated body of a display panel, such as a liquid crystal panel or an organic electroluminescent (EL) panel, and a touch sensor panel. In the positioning unit 4, touch sensors are arranged on substantially the entire display surface of the display panel. The display touch panel 4 is electrically coupled with the main circuit board of the inner case 3.

A connector hole 5A is formed in the left-side case 5. A detachable connector cover 8 is provided in the connector hole 5A in such a manner that it does not fall out from the connector hole 5A. When an external connector is passed through the connector hole 5A, the terminal of the external connector is electrically coupled with a connector terminal provided on the inner case 3.

Push-buttons 15A, 15B, 16A, and 16B are provided on the right-side case 6. On the right side of the inner case 3 at positions corresponding to the push-buttons 15A, 15B, 16A, and 16B, switches 17A, 17B, 18A, and 18B, which detect the pushing operation of the push-buttons 15A, 15B, 16A, and 16B, respectively, are provided.

The back-side case 2 accommodates the battery pack 14 and covers the back side of the inner case 3. The battery coupling contact of the battery pack 14 accommodated in the portable terminal 1 is electrically coupled with a coupling contact on the circuit board of the inner case 3. An objective lens hole 19A and an image-acquisition illumination-light source hole 19B of a camera unit provided on the back side of the inner case 3 are formed in the back-side case 2. The battery pack 14 is connected to a power terminal of the inner case 3.

The lower front case 10 is attached to the inner case 3 with a left button part 11, a center button part 12, and a right button part 13 built in. In this embodiment, the left button part 11, the center button part 12, and the right button part 13 are each horizontally long with a curve matching a part of a specific arc. When the portable terminal 1 is viewed from the front, the left button part 11 is disposed on the left side of the center button part 12 and is disposed such that its right edge adjoins the left edge of the center button part 12; the right button part 13 is disposed on the right side of the center button part 12 and is disposed such that its left edge adjoins the right edge of the center button part 12.

A light-blocking sheet 25 is attached to the front side of the inner case 3 at a position corresponding to the attachment position of the lower front case 10. The light-blocking sheet 25 is large enough to completely cover the left button part 11, the center button part 12, and the right button part 13. The light-blocking sheet 25 has loose holes 26, 27, and 28 through which protrusions (which are to be described below) are passed without contacting the sidewalls of the loose holes 26, 27, and 28 when the protrusions are inserted by a user pressing the key-tops of the left button part 11, the center button part 12, and the right button part 13.

Outline of Configuration of Button Parts and Light-Blocking Sheet

Figure 3:
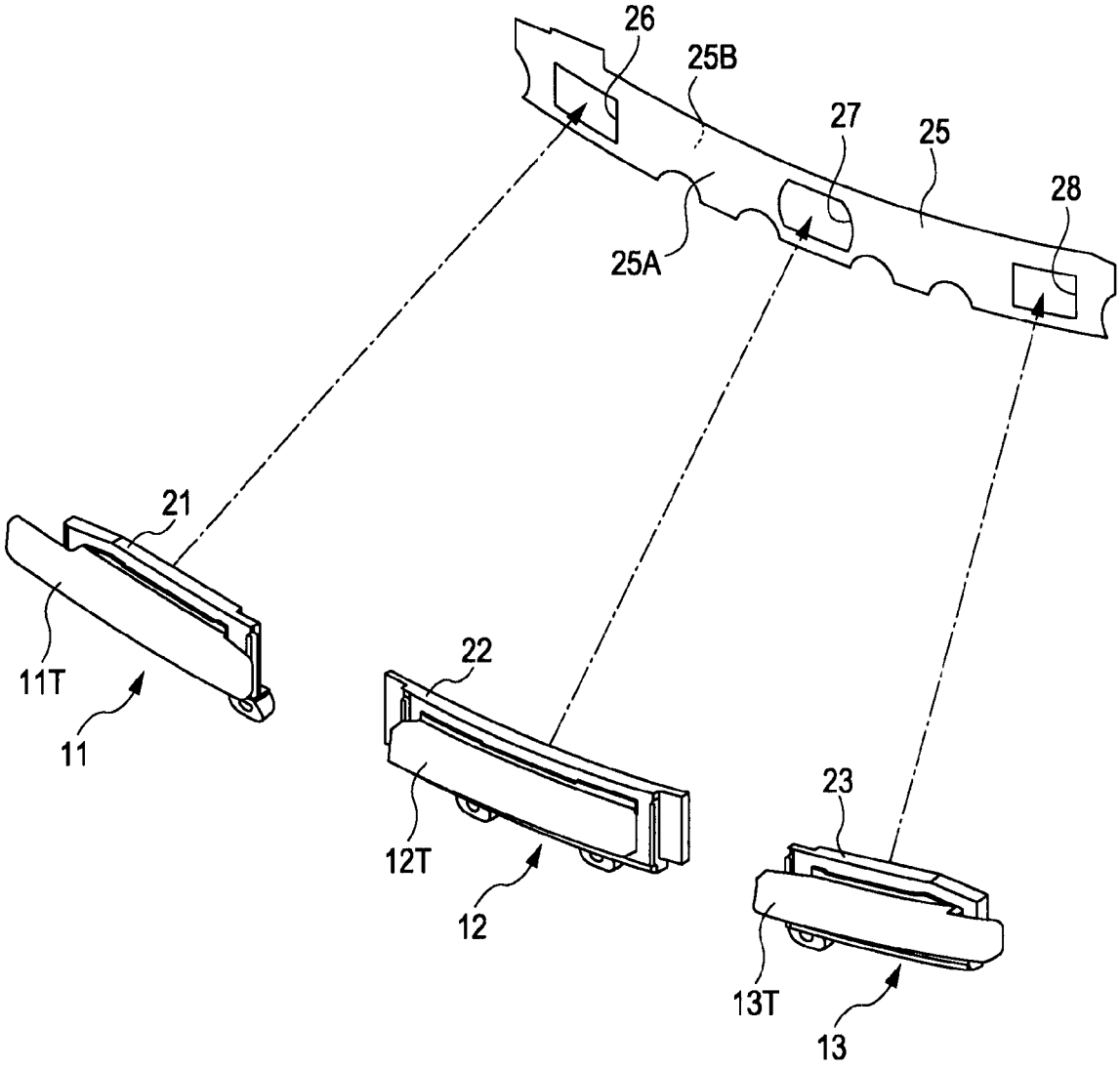
FIG. 3 illustrates an external perspective view of a left button part, a center button part, a right button part, and a light-blocking sheet of an illuminating push-button device according to this embodiment.

FIG. 3 illustrates an external perspective view of the left button part 11, the center button part 12, the right button part 13, and the light-blocking sheet 25.

As illustrated in FIG. 3, a key-top part 11T of the left button part 11 is fit together with a key rubber part 21. Similarly, a key-top part 12T of the center button part 12 is fit together with a key rubber part 22, and a key-top part 13T of the right button part 13 is fit together with a key rubber part 23. The key-top parts and the key rubber parts are fit together such that protrusions provided on the key-top parts and the key rubber parts engage as described in detail below.

The key rubber parts 21, 22, and 23 are made of transparent or semi-transparent elastic rubber material through which light passes and have rubber protrusions, which are described below.

The key-top parts 11T, 12T, and 13T are made of transparent or semi-transparent inelastic material. Light from light sources entering the key-top parts 11T, 12T, and 13T from the sides of the key rubber parts 21, 22, and 23, respectively, is emitted outward from, for example, only a specific area in substantially the middle of the long side of each key-top surface or from the entire key-top surface of each key-top part. When light is emitted outward from only a specific area in substantially the middle of the long side, light-blocking printing that prevents light from being emitted through the key-top surfaces except for the specific areas is applied on the key-top surfaces of the key-top parts 11T, 12T, and 13T.

The key-top parts 11T, 12T, and 13T have key-top protrusions, which are described below, on the sides of the key rubber parts 21, 22, and 23, respectively.

The light-blocking sheet 25 is disposed on the left button part 11, the center button part 12, and the right button part 13 on the sides of the rubber protrusions. As mentioned above, the light-blocking sheet 25 is large enough to completely cover the left button part 11, the center button part 12, and the right button part 13 and has the loose holes 26, 27, and 28, which are large enough to allow the rubber protrusions to pass through without contacting the sidewalls of the loose holes 26, 27, and 28 when, for example, a user pushes any of key-top parts 11T, 12T, and 13T into the corresponding loose holes 26, 27, and 28.

Detailed Description of Button Parts

Figure 4:
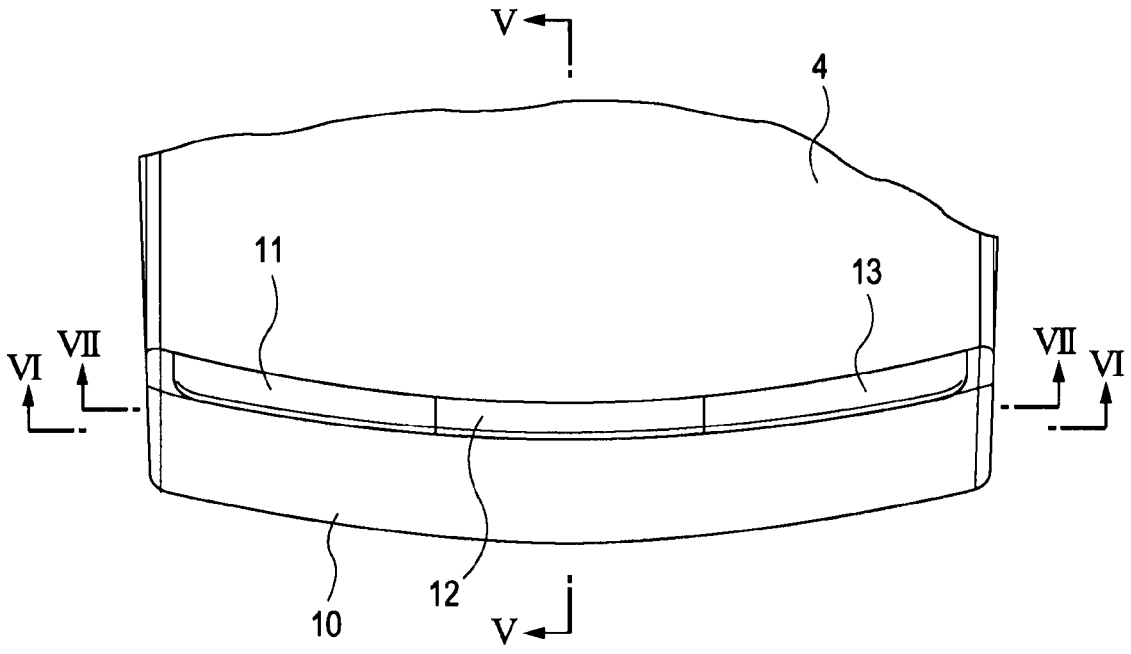
FIG. 4 is a detailed enlarged view of the area indicated by circle IV in FIG. 1.
Figure 5:
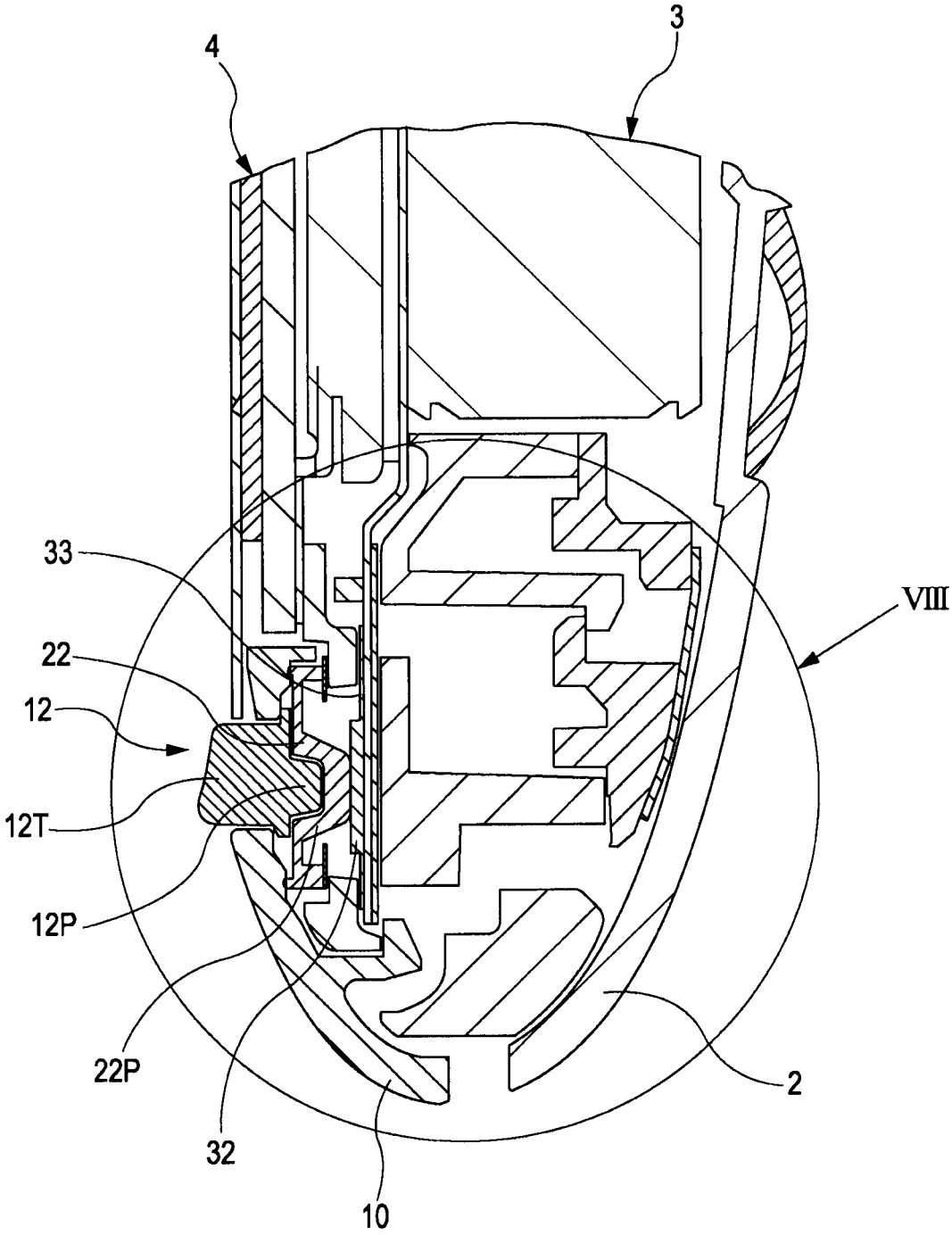
FIG. 5 is an enlarged sectional view of the portable terminal according to this embodiment taken along line V in FIG. 4.
Figure 6:
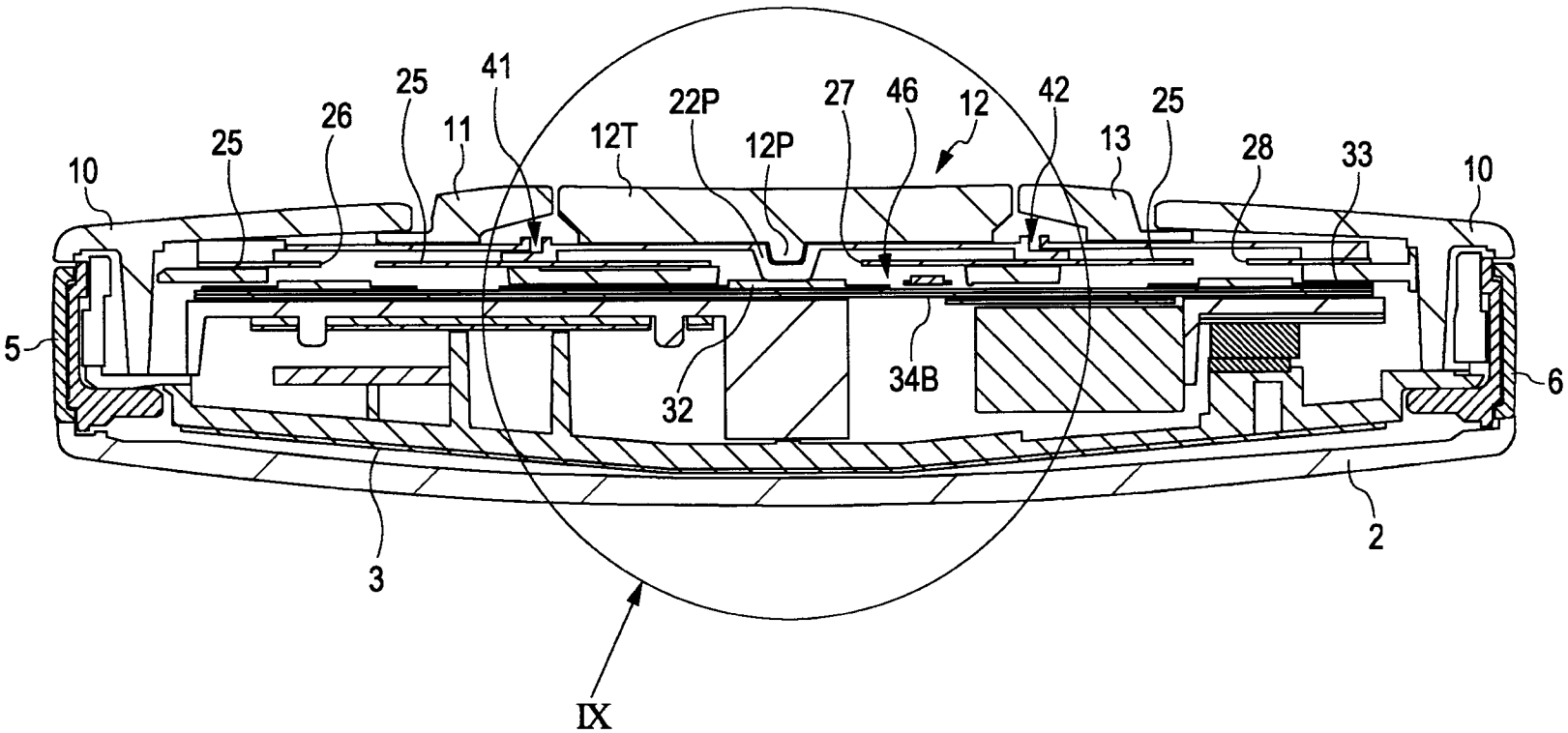
FIG. 6 is an enlarged sectional view of the portable terminal according to this embodiment taken along line VI in FIG. 4.
Figure 7:
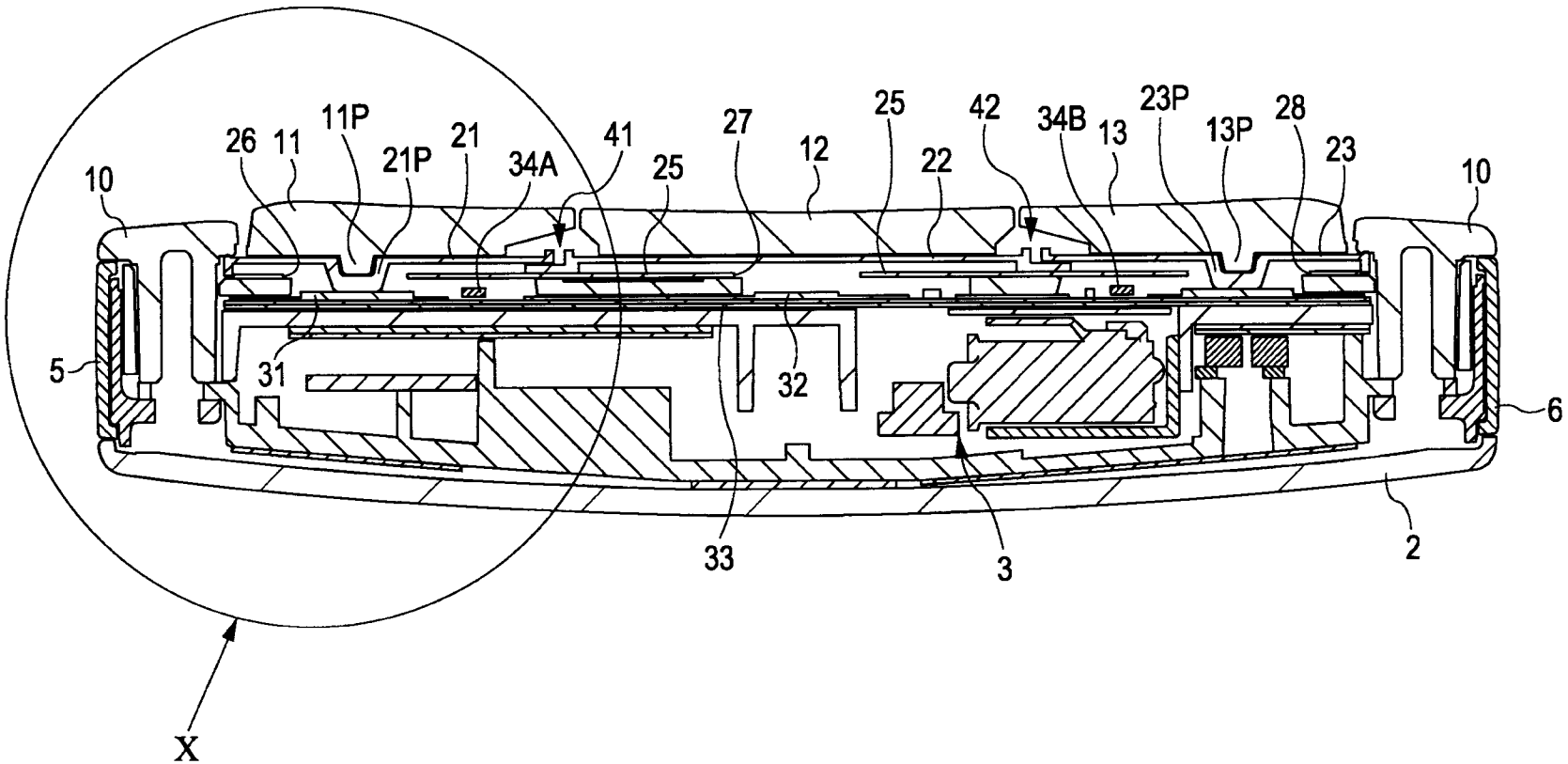
FIG. 7 is an enlarged sectional view of the portable terminal according to this embodiment taken along line VII.
Figure 8:
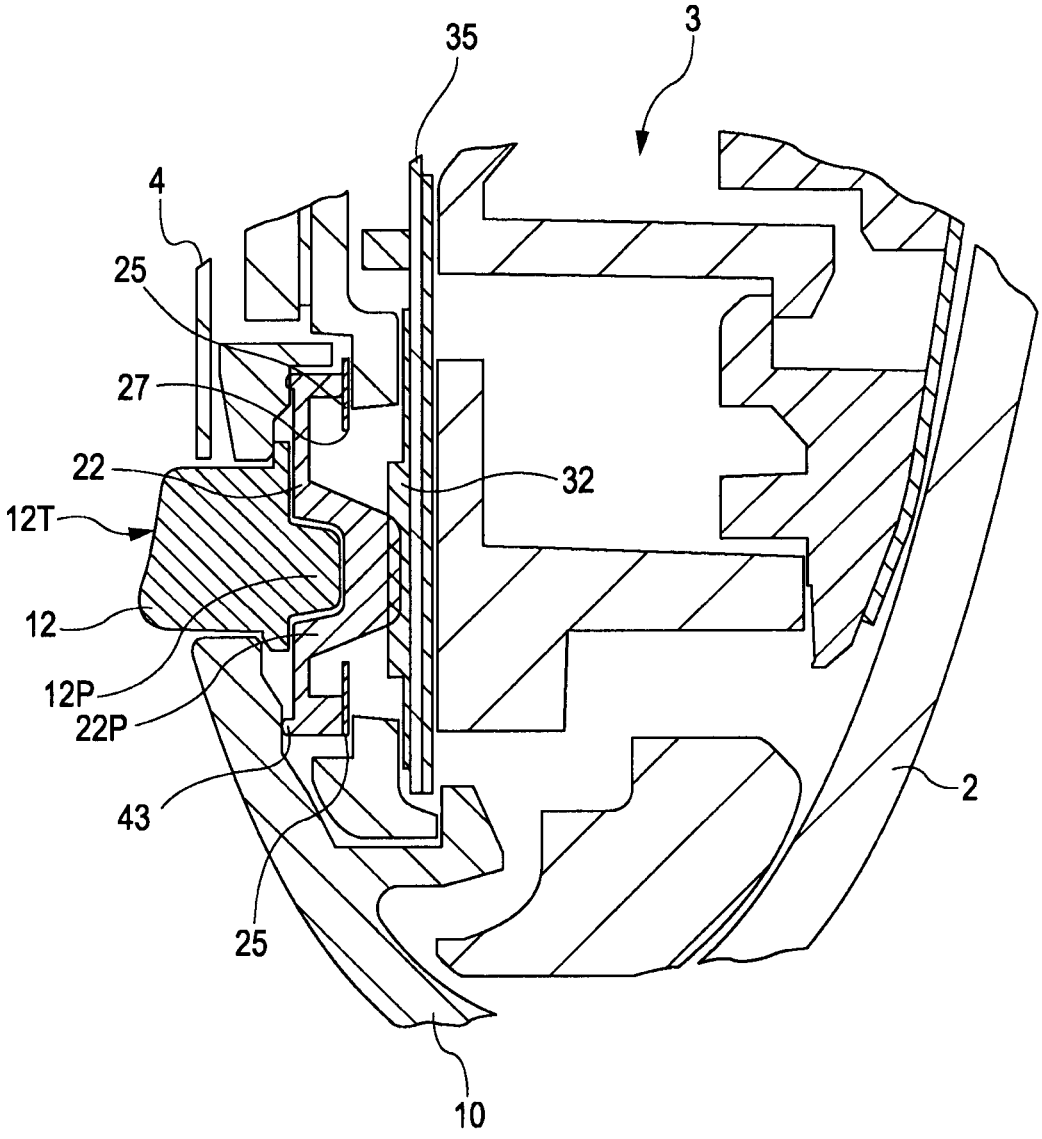
FIG. 8 is a detailed enlarged view of the area indicated by circle VIII in FIG. 5.
Figure 9:
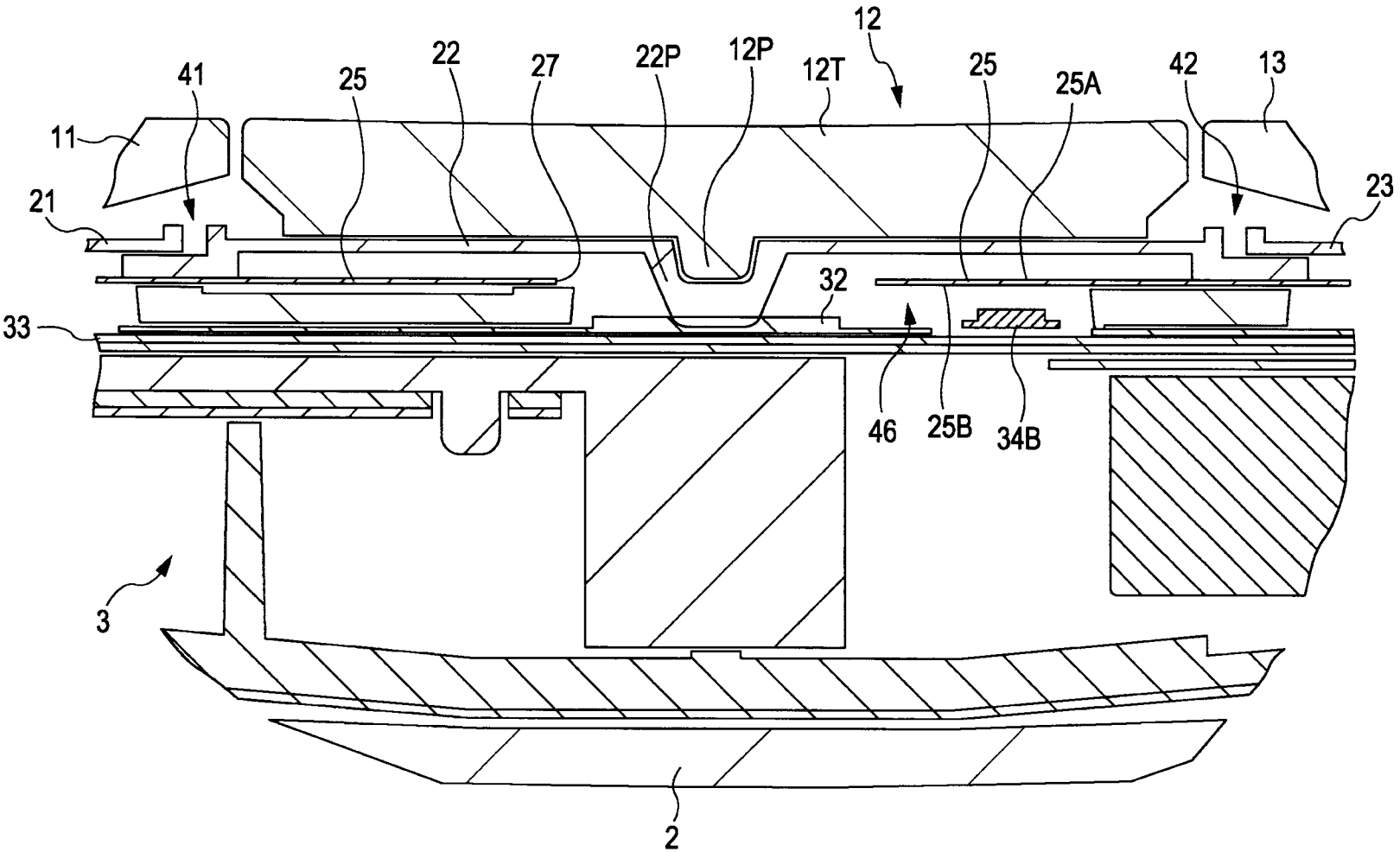
FIG. 9 is a detailed enlarged view of the area indicated by circle IX in FIG. 6.
Figure 10:
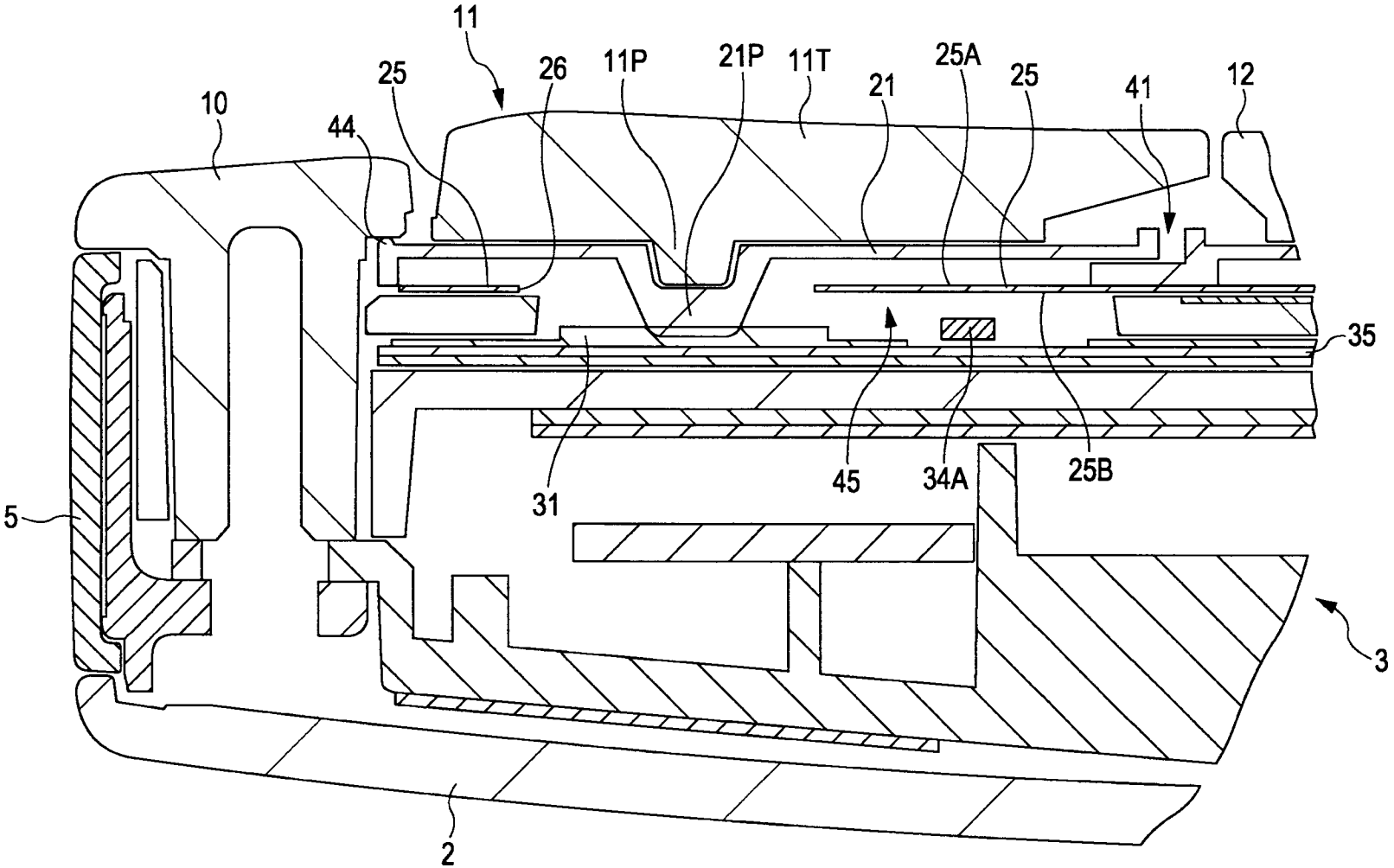
FIG. 10 is a detailed enlarged view of the area indicated by circle X in FIG. 7.

FIG. 4 is a detailed enlarged view of the area indicated by circle V in FIG. 1. FIG. 5 is an enlarged sectional view of the portable terminal 1 according to this embodiment taken along line X in FIG. 4. FIG. 6 is an enlarged sectional view of the portable terminal 1 according to this embodiment taken along line VI in FIG. 4. FIG. 7 is an enlarged sectional view of the portable terminal 1 according to this embodiment taken along line VII in FIG. 4. FIG. 8 is a detailed enlarged view of the area indicated by circle VIII in FIG. 5. FIG. 9 is a detailed enlarged view of the area indicated by circle IX in FIG. 6. FIG. 10 is a detailed enlarged view of the area indicated by circle X in FIG. 7.

As illustrated in FIGS. 4 to 10, the key-top parts 11T, 12T, and 13T of the portable terminal 1 according to this embodiment are tapered such that their bases become smaller toward the key rubber parts 21, 22, and 23 and include key-top protrusions 11P, 12P, and 13P, whose end sections are substantially flat surfaces with a substantial size. The end sections of the key-top protrusions may each be a protrusion with a gently curve, instead of a flat surface.

As described above, the key rubber parts 21, 22, and 23 are made of transparent or semi-transparent elastic rubber material through which light passes. The key-top protrusions 11P, 12P, and 13P of the key-top part 11T are embedded into the key rubber parts 21, 22, and 23, respectively. The key rubber parts 21, 22, and 23 are tapered such that their bases become smaller toward the tips and include rubber protrusions 21P, 22P, and 23P, whose end sections are flat surfaces with an appropriate thickness and a substantial size. The end sections of the rubber protrusions may each be a protrusion with a gentle curve, instead of a flat surface. Overlapping contact sections 41 and 42, which substantially bond together the key rubber parts, are provided on the key rubber parts 21, 22, and 23. For example, projections 43 and 44 are provided at sections where the key rubber parts 21, 22, and 23 contact the lower front case 10. The tips of the projections 43 and 44 are substantially bonded to the wall surface of the lower front case 10.

In the portable terminal 1 according to this embodiment, with the left button part 11, the center button part 12, and the right button part 13 fit into the case, key domes 31, 32, and 33 are disposed at positions on a circuit board 35 of the inner case 3 opposing the rubber protrusions 21P, 22P, and 23P, respectively, of the key rubber part 21.

The key domes 31, 32, and 33 are made of dome-shaped elastic material. Switching devices are disposed inside the domes. In other words, in the portable terminal 1 according to the first embodiment, when any one of the key-top parts 11T, 12T, and 13T is pushed by a user and the corresponding rubber protrusion is pushed down by the key-top protrusion of the pushed key-top part, a pushing force is applied to the key dome at the position corresponding to the rubber protrusion, and the inner switching device inside the corresponding key domes is pushed down. It is desirable that the size of the end section of each rubber protrusion match the size of the corresponding key dome.

In this way, as described above, in the illuminating push-button device according to this embodiment, the key-top parts include the key-top protrusions, and the rubber protrusions, which are fit together with the key-top protrusions, are provided on the key rubber parts and oppose the key domes. In this way, in the illuminating push-button device according to this embodiment, wide gaps are provided between the key-top surfaces and the key domes. In other words, according to this embodiment, a portable terminal having a case design in which the gaps between the key-top surfaces and the key domes are wide is realized.

As described above, in the illuminating push-button device according to this embodiment, the key-top protrusions of the key-top parts are fit into the rubber protrusions of the key rubber parts. Thus, in the illuminating push-button device according to this embodiment, the pushing force applied to the key-top surfaces by a user can be transmitted to the key domes through the key-top protrusions and the rubber protrusions. In this way, in the illuminating push-button device according to this embodiment, even when the gaps between the key-top surfaces and the key domes are wide, the pushing force applied to the key-top parts is reliably transmitted to the key domes.

In other words, the portable terminal 1 according to this embodiment realizes a case design in which the gaps between the key-top surfaces and the key domes are wide, and, at the same time, enables reliable switching operation corresponding to the pushed key-top surfaces.

In the illuminating push-button device according to this embodiment, the bases of the key-top protrusions are tapered such that the bases become smaller toward the tips and have end sections that are flat surfaces with a substantial size. Therefore, unlike bases of rectangular key-top protrusions having thin bases, the bases according to this embodiment do not break. Moreover, in the illuminating push-button device according to this embodiment, since the end sections of the rubber protrusions are flat surfaces having a substantial size and an appropriate thickness, damage to the rubber protrusions due to the end sections of the key-top protrusions and damage to the key domes can be prevented.

Furthermore, in the illuminating push-button device according to this embodiment, since the tapered key-top protrusions and the tapered rubber protrusions are fit together, the pushing force applied to the key-top parts by a user can be efficiently transmitted to the key domes, and, when a user pushes a key-top surface, an excellent clicking sense is provided to the user.

In the illuminating push-button device according to this embodiment, since the button units are formed merely by fitting together the key-top protrusions and the rubber protrusions, other new components are unnecessary, and an increase in costs due to an increase in the number of components and an increase in the number steps in the production process are prevented.

Moreover, in the illuminating push-button device according to this embodiment, the key rubber parts 21, 22, and 23 are disposed such that adjoining end sections overlap with each other, and the overlapping contact sections 41 and 42 are provided at the overlapping areas. The projections 43 and 44 are provided on the key rubber parts 21, 22, and 23 in sections that contact the lower front case 10, and the tips of the projections 43 and 44 are substantially bonded to the wall surface of the lower front case 10. Therefore, even when water, etc., enters through, for example, gaps between the key-top parts 11T, 12T, and 13T and the lower front case 10, the water, etc., is prevented from entering the side of the inner case 3 by the overlapping contact sections 41 and 42 and the projections 43 and 44. In other words, the portable terminal 1 according to this embodiment is highly waterproof.

Detailed Description of Light-Blocking Sheet

As illustrated in FIGS. 4 to 10, the portable terminal 1 according to this embodiment is provided with the light-blocking sheet 25, which is large enough to cover the left button part 11, the center button part 12, and the right button part 13, on the side of the rubber protrusions of these button parts.

The light-blocking sheet 25 has the loose holes 26, 27, and 28, which allow the rubber protrusions 21P, 22P, and 23P to pass through without contacting the sidewalls of the loose holes 26, 27, and 28, respectively, when the key-top parts 11T, 12T, and 13T are inserted by a user. The surface 25B of the light-blocking sheet 25 on the side of the inner case 3 is colored white (white printing), whereas the other surface 25B on the side of the lower front case 10 is colored black (black printing).

In the portable terminal 1 according to this embodiment, the circuit board 35 of the inner case 3 includes LEDs 34A and 34B, which are light sources.

The LED 34A is provided on the circuit board 35 at a position slightly closer to the left button part 11 with respect to the position where the edges of the left button part 11 and the center button part 12 adjoin. The LED 34B is provided on the circuit board 35 at a position slightly closer to the center button part 12 with respect to the position where the edges of the center button part 12 and the right button part 13 adjoin. The LEDs 34A and 34B are disposed such that their optical axes are disposed, for example, in a direction that is substantially orthogonal to the surface of the circuit board 35 and that is the front side of the portable terminal 1. The light emitted from the LEDs 34A and 34B is emitted with moderate spread angles centered on the optical axes.

Furthermore, in the portable terminal 1 according to this embodiment, moderately large spaces 45 and 46 are respectively provided on the side of the light-emitting surfaces of the LEDs 34A and 34B. In this embodiment, the spaces 45 and 46 are realized by providing the button parts with the above-described structure. That is, in this embodiment, moderately large spaces can be provided on the side of the light-emitting surfaces of the LEDs 34A and 34B since wide gaps can be provided between the key-top surfaces and the key domes by providing button parts with the above-described structure.

In this way, in the portable terminal 1 according to this embodiment, light emitted from the LEDs 34A and 34B can be emitted through a wider range by providing the large spaces 45 and 46 on the side of the light-emitting surfaces of the LEDs 34A and 34B. In other words, according to this embodiment, even when the LEDs 34A and 34B are disposed near, for example, the areas where the end section of the above-described horizontally long button parts 11, 12, and 13 adjoin, the light emitted from the LEDs 34A and 34B spread through the spaces and easily reach the vicinities of the centers in the horizontal direction of the button parts 11, 12, and 13.

Moreover, in the portable terminal 1 according to this embodiment, the light-blocking sheet 25 is disposed such that the white printing surface 25B faces the light-emitting surfaces of the LEDs 34A and 34B across the spaces 45 and 46. In this embodiment, white printing is applied also on the circuit board on the side of the key domes.

In this way, the light emitted from the LEDs 34A and 34B spreads through the spaces 45 and 46 and is repeatedly reflected and diffused at the white printing surface 25B of the light-blocking sheet 25 and the white printing surface of the circuit board 35. The light from the light source reflected and diffused at the white printing surfaces of the light-blocking sheet 25 and circuit board 35 passes through the loose holes 26, 27, and 28 of the light-blocking sheet 25, passes through the key rubber parts 21, 22, and 23, reaches the key-top parts 11T, 12T, and 13T, and is emitted outward from the key-top surfaces of the key-top parts 11T, 12T, and 13T.

Furthermore, according to this embodiment, the light emitted from the LEDs 34A and 34B is blocked by the light-blocking sheet 25, except for the light that passes through the loose holes 26, 27, and 28, the light does not leak out from areas other than the key-top surfaces.

In other words, the portable terminal 1 according to this embodiment eliminates unwanted light leakage and sufficiently and efficiently illuminates the key-tops.

SUMMARY

As described above, the illuminating push-button device and the portable terminal according to this embodiment of the present invention have highly flexible designs in which the gaps between the key-top surfaces and the key domes are wide due to the use of a small number of simple components, provide an excellent clicking sense when a user pushes a button, and prevent damage to the key domes, the key rubber parts, and the protrusions of the key-top parts.

Moreover, the illuminating push-button device and the portable terminal according to this embodiment have highly flexible designs, such as the buttons having horizontally long key-top parts, evenly and efficiently illuminate the key-top parts at such button parts using a small number of light sources while preventing unwanted light leakage, and prevent water from seeping inside.

The above-described embodiment is merely an example of the present invention. Therefore, the embodiment of the present invention is not limited, and various modifications may be made within the scope of the invention.

In the embodiment described above, an illuminating push-button device according to the embodiment is applied to a portable terminal. The present invention, however, is not limited thereto and may be applied to any type of electronic apparatus having an illuminating push-button that illuminates a key-top from the inside.

What is claimed is:

1. An illuminating push-button device comprising:

a key-top part having a key-top surface and a first protrusion that protrudes from a back side of said key-top surface;

a key rubber part made of a transparent or semi-transparent elastic material and having a second protrusion that receives the first protrusion, said second protrusion being oriented in a common direction as said first protrusion;

a switching device that opposes the second protrusion is positioned to be actuated in response to the key-top part being depressed;

a lower front case;

a light-source element that emits light from a light-emitting surface thereof; and a light-blocking sheet disposed between the light-source element and the key rubber part, wherein the light emitting surface faces in a direction of the light-blocking sheet, wherein said light-blocking sheet covers at least a portion of the light-emitting surface of the light-source element and has a loose hole through which the second protrusion of the key rubber part is passed, and wherein each of the protrusions faces in a direction of the switching device, wherein said key-top part, key rubber part and switching device are part of a first key assembly, and said device includes a second key assembly, said second key assembly also having a key-top part having a key-top surface, key rubber part, and switching device, wherein the key rubber part of the first key assembly and the key rubber part of the second key assembly are provided within the lower front case, wherein each key rubber part includes a projection that contacts the lower front case, and wherein a tip of each projection is bonded to the lower front case.

2. The device of claim 1, wherein said second protrusion extends through the loose hole without contacting a sidewall of the loose hole.

3. The device of claim 2, wherein said light-blocking sheet is colored white on a side facing the light-emitting surface of the light-source element and color shaded on the opposite side.

4. The device of claim 1, wherein each key-top part comprises a transparent or semi-transparent material allowing incident light from the light-source element to be emitted externally from at least a part of each key-top surface.

5. The device of claim 1, wherein, each key rubber part is waterproof and is positioned to protect each switching device and said light-source element from water damage.

6. The device according to claim 1, wherein:

said first key assembly and said second key assembly being adjacent to each other; and said light-blocking sheet having a second loose hole to accommodate the second key assembly.

7. The device of claim 6, wherein respective key rubber parts of the first key assembly and the second key assembly overlap in a vertical direction to provide waterproofing.

8. The device of claim 1, wherein each switching device is disposed within a key dome made of a dome-shaped elastic material, and an outer surface of said key dome being white.

9. A portable terminal apparatus, comprising:

an illuminating push-button device including a key-top part having a key-top surface and a first protrusion that protrudes from a back side of said key-top surface, a key rubber part made of a transparent or semi-transparent elastic material and having a second protrusion that receives the first protrusion, said second protrusion being oriented in a common direction as said first protrusion, a switching device that opposes the second protrusion and is configured to be actuated in response to the key-top part being depressed, wherein each of the protrusions faces in a direction of the switching device, a lower front case, a light-source element that emits light from a light-emitting surface thereof, and a light-blocking sheet disposed between the light-source element and the key rubber part, wherein the light-emitting surface faces in a direction of the light blocking sheet, wherein said light-blocking sheet covers at least a portion of the light-emitting surface of the light-source element and has a loose hole through which the second protrusion of the key rubber part is passed, wherein said key-top part, key rubber part and switching device are part of a first key assembly, and said device includes a second key assembly, said second key assembly also having a key-top part having a key-top surface, key rubber part, and switching device, wherein the key rubber part of the first key assembly and the key rubber part of the second key assembly are provided within the lower front case, wherein each key rubber part includes a projection that contacts the lower front case, and wherein a tip of each projection is bonded to the lower front case; and a terminal case exposing each key-top surface of the illuminating push-button device in an external direction and accommodating each key rubber part, each switching device, the light-source element, and the light-blocking sheet.

10. The apparatus of claim 9, wherein said second protrusion extends through the loose hole without contacting a sidewall of the loose hole.

11. The apparatus of claim 10, wherein said light-blocking sheet is colored white on the side of the light-emitting surface of the light-source element and color shaded on the opposite side.

12. The apparatus of claim 9, wherein each key-top part comprises a transparent or semi-transparent material allowing incident light from the light-source element to be emitted externally from at least a part of each key-top surface.

13. The apparatus of claim 9, wherein, each key rubber part is waterproof and is positioned to protect each switching device and said light-source element from water damage.

14. The apparatus according to claim 9, wherein:

said first key assembly and said second key assembly being adjacent to each other; and said light-blocking sheet having a second loose hole to accommodate the second key assembly.

15. The apparatus of claim 14, wherein key rubber parts of the first key assembly and the second key assembly overlap in a vertical direction to provide waterproofing.

16. The apparatus of claim 9, wherein each switching device is disposed within a key dome made of a dome-shaped elastic material, and an outer surface of said key dome being white.

17. An illuminating push-button device comprising:

a key-top part having a key-top surface and a first protrusion that protrudes from a back side of said key-top surface;

means for receiving the first protrusion, wherein the means for receiving includes a second protrusion, and each of the first and second protrusions face in a direction away from the back side, said means for receiving including means for conveying a depressive force applied to said key-top part, and means for permitting light to pass through said means for receiving;

a switching device that is positioned to be actuated in response to the depressive force being applied to the key-top part and conveyed by said means for conveying;

a lower front case;

a light-source element that emits light from a light-emitting surface thereof; and a light-blocking sheet disposed between the light-source element and means for conveying, wherein the light-emitting surface faces in a direction of the light-blocking sheet, wherein said light-blocking sheet covers at least a portion of the light-emitting surface of the light-source element and a loose hole, wherein said key-top part, means for receiving and switching device are part of a first key assembly, and said device includes a second key assembly, said second key assembly also having a key-top part, means for receiving, and switching device, wherein the means for receiving of the first key assembly and the means for receiving of the second key assembly are provided within the lower front case, wherein each means for receiving includes a projection that contacts the lower front case, and wherein a tip of each projection is bonded to the lower front case.

18. The illuminating push-button device of claim 17, wherein each means for receiving includes means for protecting each switching device and said light source element from water damage.

* * * * *